US010332447B2

(12) United States Patent
Li

(10) Patent No.: US 10,332,447 B2
(45) Date of Patent: Jun. 25, 2019

(54) PIXEL CIRCUIT, DRIVING METHOD THEREFOR, AND DISPLAY DEVICE INCLUDING THE PIXEL CIRCUIT

(71) Applicant: BOE TECHNOLOGY GROUP CO., LTD., Beijing (CN)

(72) Inventor: Yunfei Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/525,807

(22) PCT Filed: Mar. 7, 2016

(86) PCT No.: PCT/CN2016/075800
§ 371 (c)(1),
(2) Date: May 10, 2017

(87) PCT Pub. No.: WO2016/155471
PCT Pub. Date: Oct. 6, 2016

(65) Prior Publication Data

US 2018/0005569 A1 Jan. 4, 2018

(30) Foreign Application Priority Data

Mar. 31, 2015 (CN) ..... 2015 1 0148701

(51) Int. Cl.
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/08* (2013.01); *G09G 2320/0233* (2013.01); *G09G 2320/043* (2013.01); *G09G 2330/021* (2013.01)

(58) Field of Classification Search
None
See application file for complete search history.

(56) References Cited

U.S. PATENT DOCUMENTS

2007/0091048 A1 4/2007 Sun
2008/0129212 A1* 6/2008 Chen ..... G09G 3/3233 315/169.1

(Continued)

FOREIGN PATENT DOCUMENTS

CN 102646386 A 6/2012
CN 102903333 A 1/2013

(Continued)

OTHER PUBLICATIONS

International Search Report dated Jun. 1, 2016.

(Continued)

*Primary Examiner* — Chad M Dicke
(74) *Attorney, Agent, or Firm* — Dilworth & Barrese, LLP.; Michael J. Musella, Esq.

(57) ABSTRACT

A pixel circuit, a driving method therefor, and a display device. The pixel circuit comprises a first transistor, a second transistor, a third transistor, a fourth transistor, a fifth transistor, a sixth transistor, a seventh transistor, an eighth transistor, a storage capacitor, and a light-emitting device. The pixel circuit can avoid the influence of drifting of a threshold voltage on brightness uniformity and constancy of a display.

17 Claims, 6 Drawing Sheets

(56) References Cited

U.S. PATENT DOCUMENTS

| | | | | |
|---|---|---|---|---|
| 2011/0134100 | A1 | 6/2011 | Chung | |
| 2014/0132162 | A1* | 5/2014 | Kim | G09G 3/3266 315/161 |
| 2014/0152719 | A1 | 6/2014 | Jung | |
| 2014/0198085 | A1* | 7/2014 | Park | G09G 3/3233 345/207 |

FOREIGN PATENT DOCUMENTS

| | | | |
|---|---|---|---|
| CN | 103226931 | A | 7/2013 |
| CN | 103456264 | A | 12/2013 |
| CN | 104021757 | A | 9/2014 |
| CN | 04700780 | | 6/2015 |
| CN | 105225626 | A | 1/2016 |
| KR | 100833753 | B1 | 5/2006 |

OTHER PUBLICATIONS

First Chinese Office Action dated August.
Second Chinese Office Action dated Dec. 19, 2016.
Chinese Office Action dated May 25, 2017.

* cited by examiner

PIXEL CIRCUIT, DRIVING METHOD THEREFOR, AND DISPLAY DEVICE INCLUDING THE PIXEL CIRCUIT

TECHNICAL FIELD

The present disclosure relates to a pixel circuit and a driving method for the pixel circuit, and a display device.

BACKGROUND

With the rapid progress of display technology, semiconductor element technology, as the core of display devices, has also made a leap in advancement. For known display devices, Organic Light Emitting Diode (OLED for short) are being used more and more in high-performance display areas as a current-type light emitting device because of having characteristics such as self-luminescence, fast responding, wide viewing angle, and capability of being fabricated on flexible substrates. OLED may be divided into two types of Passive Matrix Driving OLED (PMOLED for short) and Active Matrix Driving OLED (AMOLED for short), AMOLED display is expected to replace liquid crystal display (LCD for short) to be a next-generation new flat panel display, for it has advantages such as low manufacturing cost, high response speed, power saving, capability of being applied to DC driving of portable devices, a wide range of working temperature etc.

However, in technical solutions of the prior art, as for a large-sized AMOLED display, a plurality of thin film transistors (TFTs for short) are disposed on an array substrate of the AMOLED display. In order to increase carrier mobility of said TFTs and reduce resistivity, and thereby lessen power consumption when the same current flows through, usually polysilicon is adopted to constitute said TFTs. However, due to manufacturing process and characteristics of polysilicon, when a TFT switching circuit is fabricated on a glass substrate of a large area, often there are fluctuations of electrical parameters such as threshold voltage Vth, mobility and so on, so that the current flowing through the OLED device not only changes with a change of on-voltage stress caused by long-term turning-on of the TFTs, but also varies depending on drifting of the threshold voltage Vth of the TFTs. In this way, luminance uniformity and luminance constancy of the display will be affected.

In summary, in displaying process of the AMOLED display, luminance uniformity may be decreased due to drifting of the threshold voltage, which may cause an image quality of the display to be lowered.

SUMMARY

At least one embodiment of the present disclosure provides a pixel circuit and a driving method for the pixel circuit, and a display device, to prevent drifting of the threshold voltage from affecting luminance uniformity and luminance constancy of the display.

According to an aspect of the present disclosure, there is provided a pixel circuit, comprising: a first transistor, a second transistor, a third transistor, a fourth transistor, a fifth transistor, a sixth transistor, a seventh transistor, an eighth transistor, a storage capacitor, and a light emitting device;

a gate of the first transistor is connected to a first signal input terminal, a first electrode of the first transistor is connected to a first voltage terminal or a second voltage terminal, and a second electrode of the first transistor is connected to a first electrode of the second transistor;

a gate of the second transistor is connected to a second signal input terminal, and a second electrode of the second transistor is connected to a first electrode of the eighth transistor;

a gate of the third transistor is connected to one terminal of the storage capacitor, a first electrode of the third transistor is connected to the first electrode of the eighth transistor, and a second electrode of the third transistor is connected to a first electrode of the fourth transistor;

a gate of the fourth transistor is connected to the second signal input terminal, and a second electrode of the fourth transistor is connected to a data voltage terminal;

a gate of the fifth transistor is connected to the second signal input terminal, a first electrode of the fifth transistor is connected to the second voltage terminal, and a second electrode of the fifth transistor is connected to the other terminal of the storage capacitor;

a gate of the sixth transistor is connected to an enable signal terminal, a first electrode of the sixth transistor is connected to the other terminal of the storage capacitor, and a second electrode of the sixth transistor is connected to a first electrode of the seventh transistor, a gate of the seventh transistor is connected to the enable signal terminal, the first electrode of the seventh transistor is connected to a third voltage terminal, and a second electrode of the seventh transistor is connected to the second electrode of the third transistor;

a gate of the eighth transistor is connected to the enable signal terminal, and a second electrode of the eighth transistor is connected to an anode of the light emitting device; and a cathode of the light emitting device is connected to a fourth voltage terminal.

According to another aspect of the present disclosure, there is provided a display device, comprising the pixel circuit described above.

According to yet another aspect of the present disclosure, there is provided a driving method for driving the pixel circuit described above, comprising:

turning on the first transistor and the third transistor, turning off the second transistor, the fourth transistor, the fifth transistor, the sixth transistor, the seventh transistor, and the eighth transistor; resetting a gate voltage of the third transistor through a voltage signal of the first voltage terminal or the second voltage terminal;

turning on the second transistor, the third transistor, the fourth transistor, and the fifth transistor, and turning off the first transistor, the sixth transistor, the seventh transistor, and the eighth transistor; writing a data voltage inputted from the data voltage terminal to the second electrode of the third transistor, so as to charge the gate of the third transistor, and writing a voltage inputted from the second voltage terminal to the other terminal of the storage capacitor; and turning on the third transistor, the sixth transistor, the seventh transistor, and the eighth transistor, turning off the first transistor, the second transistor, the fourth transistor, and the fifth transistor; and driving the light emitting device to emit light through currents of the third transistor and the eighth transistor.

The embodiment of the present disclosure provides a pixel circuit and a driving method for the pixel circuit, and a display device, wherein the pixel circuit comprises a first transistor, a second transistor, a third transistor, a fourth transistor, a fifth transistor, a sixth transistor, a seventh transistor, an eighth transistor, a storage capacitor, and a light emitting device. For example, a gate of the first transistor is connected to a first signal input terminal, a first electrode of the first transistor is connected to a first voltage terminal or a second voltage terminal, and a second electrode of the first transistor is connected to a first electrode of the second transistor; a gate of the second transistor is connected to a second signal input terminal, and a second electrode of the second transistor is connected to a first electrode of the eighth transistor; a gate of the third transistor is connected to one terminal of the storage capacitor, a first electrode of the third transistor is connected to the first electrode of the eighth transistor, and a second electrode of the third transistor is connected to a first electrode of the fourth transistor; a gate of the fourth transistor is connected to the second signal input terminal, and a second electrode of the fourth transistor is connected to a data voltage terminal; a gate of the fifth transistor is connected to the second signal input terminal, a first electrode of the fifth transistor is connected to the second voltage terminal, and a second electrode of the fifth transistor is connected to the other terminal of the storage capacitor; a gate of the sixth transistor is connected to an enable signal terminal, a first electrode of the sixth transistor is connected to the other terminal of the storage capacitor, and a second electrode of the sixth transistor is connected to a first electrode of the seventh transistor, a gate of the seventh transistor is connected to the enable signal terminal, the first electrode of the seventh transistor is connected to a third voltage terminal, and a second electrode of the seventh transistor is connected to the second electrode of the third transistor; a gate of the eighth transistor is connected to the enable signal terminal, and a second electrode of the eighth transistor is connected to an anode of the light emitting device; and a cathode of the light emitting device is connected to a fourth voltage terminal.

In this way, the pixel circuit implements switching control and charging-discharging control over the circuit through a plurality of transistors and one storage capacitor, and keeps the voltage between two terminals of the storage capacitor constant due to a bootstrap function of the storage capacitor, so that the current flowing through the light emitting diode is independent of the threshold voltage of the TFTs, therefore, the problem of driving current instability and display luminance unevenness caused by drifting of the threshold voltage can be avoided.

DETAILED DESCRIPTION OF THE EMBODIMENTS

Hereinafter, the technical solutions in the embodiments of the present disclosure will be described clearly and comprehensively in combination with the drawings in the embodiments of the present disclosure, obviously, these described embodiments are only parts of the embodiments of the present disclosure, rather than all of the embodiments thereof. All the other embodiments obtained by those of ordinary skill in the art based on the embodiments of the present disclosure without paying creative efforts fall into the protection scope of the present disclosure.

Figure 1:
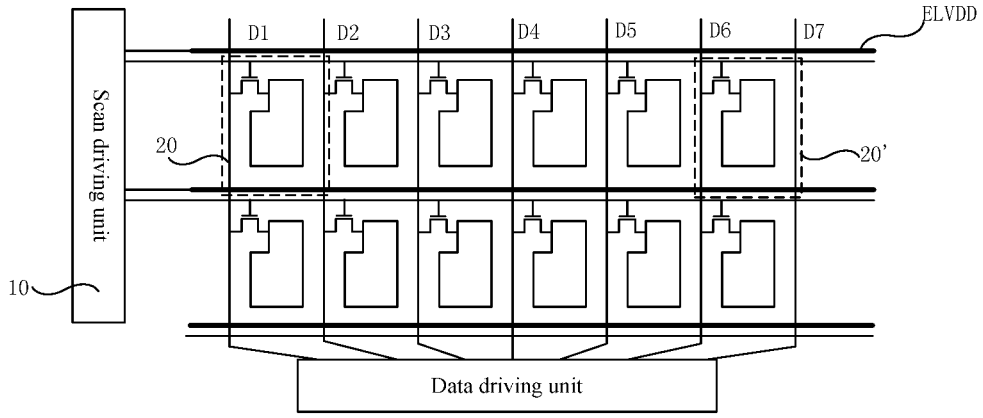
FIG. 1 is a schematic diagram of structure of an array substrate provided by a technical solution in the prior art.

FIG. 1 is a schematic diagram of structure of an array substrate provided by a technical solution in the prior art. When an OLED device emits light, driving currents of all the pixels are caused by that a power supply voltage is supplied by a scan driving unit 10 shown in FIG. 1 to respective pixel units 20 through a driving control line ELVDD, but the driving control line ELVDD has a certain resistance, thus, during the light emitting phase, a power supply voltage inputted to a pixel unit 20 located at a position closer to the scan driving unit 10 is higher than a power supply voltage inputted to a pixel unit (e.g., pixel units 20' in the last column) located at a position farther from the scan driving unit 10. This phenomenon is called resistance drop (IR Drop). Since the power supply voltage inputted by the scan driving unit 10 to the pixel unit 20 (or the pixel unit 20') is related to the current flowing through each pixel unit, thus the IR drop causes the current flowing through the pixel unit 20 at a different position to be different, which makes an AMOLED display have luminance difference at the time of displaying.

Figure 2:
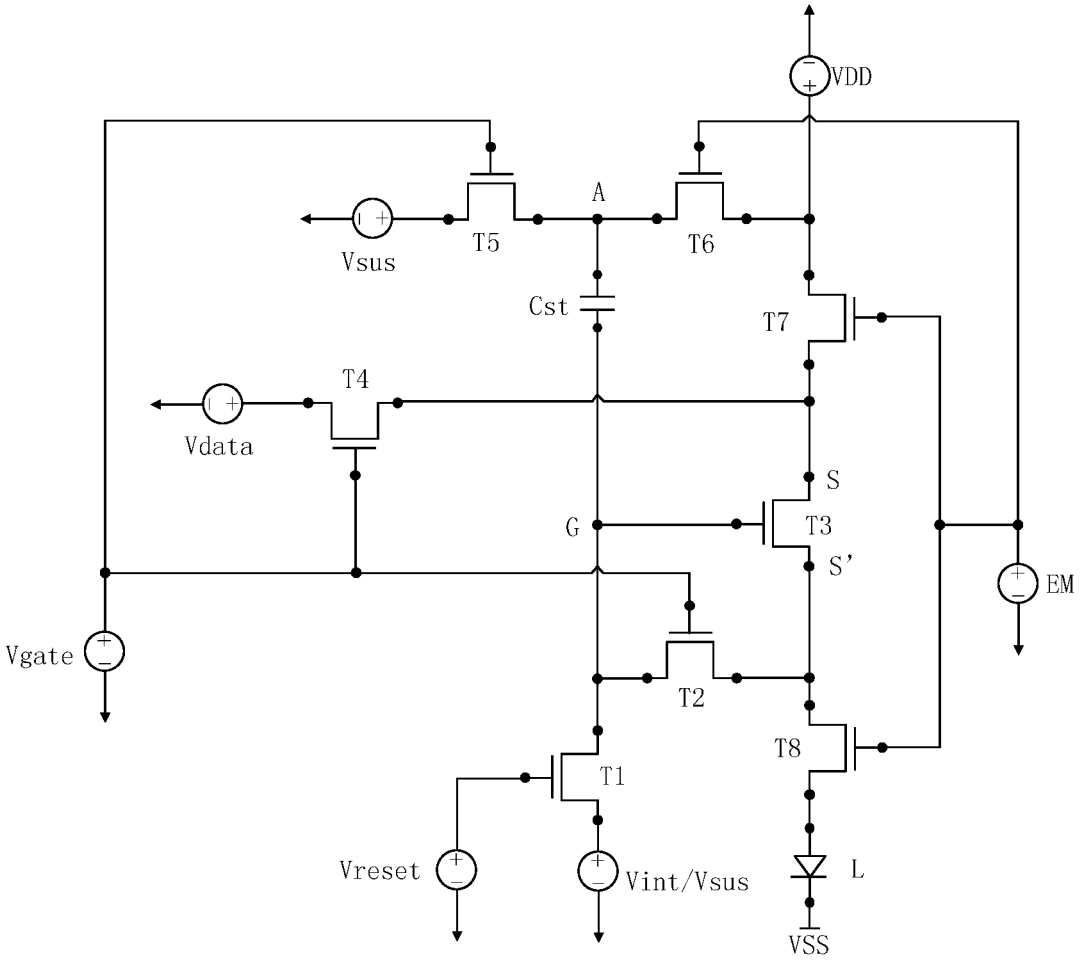
FIG. 2 is a schematic diagram of structure of a pixel circuit provided by an embodiment of the present disclosure.

FIG. 2 is a schematic diagram of structure of a pixel circuit provided by an embodiment of the present disclosure. As shown in FIG. 2, the pixel circuit may comprise a first transistor T1, a second transistor T2, a third transistor T3, a fourth transistor T4, a fifth transistor T5, a sixth transistor T6, a seventh transistor T7, an eighth transistor T8, a storage capacitor Cst, and a light emitting device L.

For example, a gate of the first transistor T1 is connected to a first signal input terminal Vreset, a first electrode of the first transistor T1 is connected to a first voltage terminal Vint or a second voltage terminal Vsus, and a second electrode of the first transistor T1 is connected to a first electrode of the second transistor T2;

a gate of the second transistor T2 is connected to a second signal input terminal Vgate, and a second electrode of the second transistor T2 is connected to a first electrode of the eighth transistor T8;

a gate of the third transistor T3 is connected to one terminal of the storage capacitor Cst, a first electrode of the third transistor T3 is connected to the first electrode of the eighth transistor T8, and a second electrode of the third transistor T3 is connected to a first electrode of the fourth transistor T4;

a gate of the fourth transistor T4 is connected to the second signal input terminal Vgate, and a second electrode of the fourth transistor T4 is connected to a data voltage terminal Vdata;

a gate of the fifth transistor T5 is connected to the second signal input terminal Vgate, a first electrode of the fifth transistor T5 is connected to the second voltage terminal Vsus, and a second electrode of the fifth transistor T5 is connected to the other terminal of the storage capacitor Cst;

a gate of the sixth transistor T6 is connected to an enable signal terminal EM, a first electrode of the sixth transistor T6 is connected to the other terminal of the storage capacitor Cst, and a second electrode of the sixth transistor T6 is connected to a first electrode of the seventh transistor T7, a gate of the seventh transistor T7 is connected to the enable signal terminal EM, the first electrode of the seventh transistor T7 is connected to a third voltage terminal VDD, and a second electrode of the seventh transistor T7 is connected to the second electrode of the third transistor T3;

a gate of the eighth transistor T8 is connected to the enable signal terminal EM, and a second electrode of the eighth transistor T8 is connected to an anode of the light emitting device L; and a cathode of the light emitting device L is connected to a fourth voltage terminal VSS.

It should be noted that, the light emitting device L in the embodiments of the present disclosure may be various types of current-driven light emitting devices in the technical solutions of the prior art, including Light Emitting Diode (LED for short) or Organic Light Emitting Diode (OLED for short). In the embodiments of the present disclosure, OLED is used as an example to provide illustration, and in the OLED pixel circuit shown in FIG. 2, a voltage inputted from the third voltage terminal VDD is the power supply voltage inputted by the driving control line ELVDD as shown in FIG. 1.

An embodiment of the present disclosure provides a pixel circuit comprising a first transistor, a second transistor, a third transistor, a fourth transistor, a fifth transistor, a sixth transistor, a seventh transistor, an eighth transistor, a storage capacitor, and a light emitting device. For example, a gate of the first transistor is connected to a first signal input terminal, a first electrode of the first transistor is connected to a first voltage terminal or a second voltage terminal, and a second electrode of the first transistor is connected to a first electrode of the second transistor; a gate of the second transistor is connected to a second signal input terminal, and a second electrode of the second transistor is connected to a first electrode of the eighth transistor; a gate of the third transistor is connected to one terminal of the storage capacitor, a first electrode of the third transistor is connected to the first electrode of the eighth transistor, and a second electrode of the third transistor is connected to a first electrode of the fourth transistor; a gate of the fourth transistor is connected to the second signal input terminal, and a second electrode of the fourth transistor is connected to a data voltage terminal; a gate of the fifth transistor is connected to the second signal input terminal, a first electrode of the fifth transistor is connected to the second voltage terminal, and a second electrode of the fifth transistor is connected to the other terminal of the storage capacitor; a gate of the sixth transistor is connected to an enable signal terminal, a first electrode of the sixth transistor is connected to the other terminal of the storage capacitor, and a second electrode of the sixth transistor is connected to a first electrode of the seventh transistor, a gate of the seventh transistor is connected to the enable signal terminal, the first electrode of the seventh transistor is connected to a third voltage terminal, and a second electrode of the seventh transistor is connected to the second electrode of the third transistor; a gate of the eighth transistor is connected to the enable signal terminal, and a second electrode of the eighth transistor is connected to an anode of the light emitting device; and a cathode of the light emitting device is connected to a fourth voltage terminal.

In this way, the pixel circuit implements switching control and charging-discharging control over the circuit through a plurality of transistors and one storage capacitor, and keeps the voltage between two terminals of the storage capacitor constant due to a bootstrap function of the storage capacitor, so that the current flowing through the light emitting diode is independent of the threshold voltage of the TFTs, therefore, the problem of driving current instability and display luminance unevenness caused by drifting of the threshold voltage can be avoided.

It should be noted that, first, in the embodiments of the present disclosure, a voltage inputted from the third voltage terminal VDD may be a high voltage, and a voltage inputted from the first voltage terminal Vint and a voltage inputted from the fourth voltage terminal VSS may be a low voltage or a grounding voltage; herein, the high voltage and low voltage represent only relative magnitude relationship between the inputted voltages.

Second, according to a different channel type of the transistors, the transistors may be divided into P-channel transistors (referred to as P-type transistors) and N-channel transistors (referred to as N-type transistors).

When a transistor is a P-type transistor, since carriers in the P-type transistor are hole-transported, thus a potential at a drain thereof is low and a potential at a source thereof is high. For example, when the third transistor T3 serving as a driving transistor in FIG. 2 is a P-type transistor, the potential at the first electrode is the potential of the fourth voltage terminal to which a low level is inputted, the potential at the second electrode is the potential of the third voltage terminal VDD to which a high level is inputted, thus the first electrode is a drain, the second electrode is a source. Therefore, when each of the transistors in the embodiments of the present disclosure is a P-type transistor, the first electrode may be the drain, and the second electrode may be the source.

When a transistor is an N-type transistor, since carriers in the N-type transistor are electron-transported, thus a potential at a drain thereof is high and a potential at a source thereof is low. Likewise, it can be derived that, when each of the transistors in the embodiments of the present disclosure is an N-type transistor, the first electrode may be the source, and the second electrode may be the drain.

In addition, the transistors in the pixel circuit described above may be divided into enhancement type transistors and depletion type transistors depending on a conducting mode of the transistors, and all the following embodiments are described with the enhancement type transistor as an example.

Figure 3A:
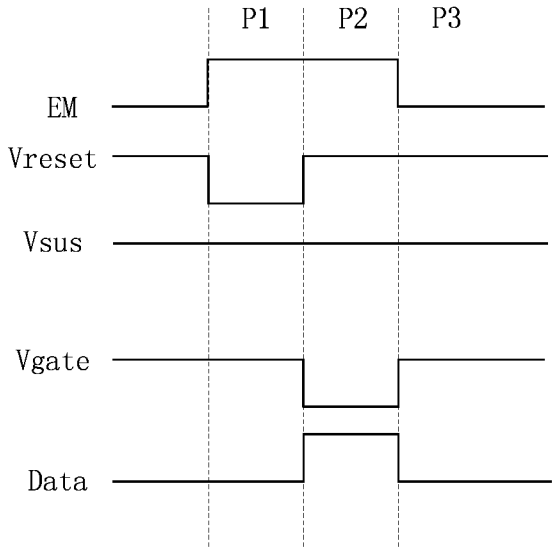
FIG. 3*a* is a timing diagram of a control signal for controlling the pixel circuit shown in FIG. 2 provided by an embodiment of the present disclosure.
Figure 3B:
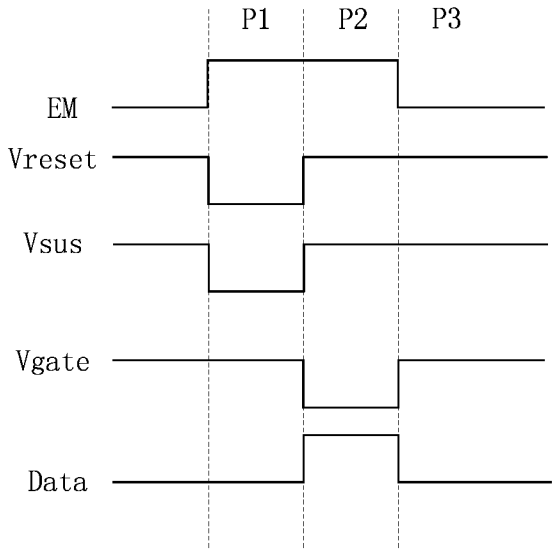
FIG. 3*b* is another timing diagram of a control signal for controlling the pixel circuit shown in FIG. 2 provided by an embodiment of the present disclosure.

FIGS. 3*a* and 3*b* are a timing diagram of a control signal for controlling the pixel circuit shown in FIG. 2 provided by an embodiment of the present disclosure each. Next, operation process of the pixel circuit provided by the embodiment of the present disclosure will be described in detail through exemplary embodiments and with reference to the timing diagrams (FIG. 3*a* or 3*b*).

First Embodiment

In this embodiment, illustration is provided with each of the transistors being a P-type transistor as an example.

In this embodiment, illustration is provided with the first electrode of the first transistor T1 being connected to the first voltage terminal Vint in the pixel circuit shown in FIG. 2 as an example, and the control signal in the pixel circuit is shown in FIG. 3*a*, wherein the second voltage terminal Vsus always outputs a high level. The operation process of the pixel circuit may be divided into three phases of a reset phase P1, a writing phase P2, and a light emitting phase P3.

Figure 4:
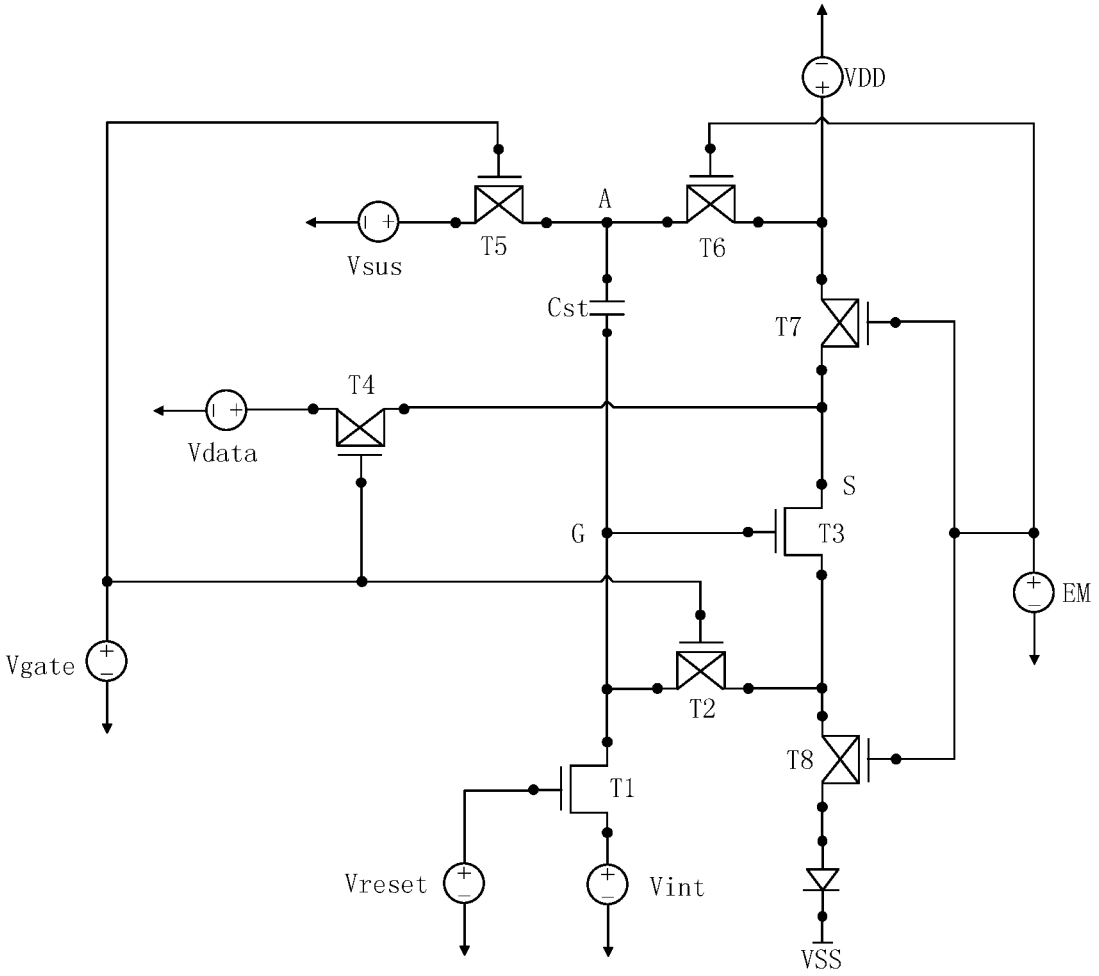
FIG. 4 is an equivalent circuit diagram of the pixel circuit of FIG. 2 in a phase P1 of FIG. 3*a;*

FIG. 4 is an equivalent circuit diagram of the pixel circuit of FIG. 2 in a phase P1 of FIG. 3*a*. As shown in FIG. 4, in the reset phase P1, a low level is inputted to the first signal input terminal Vreset to turn on the first transistor T1, so that the low level inputted from the first voltage terminal Vint can reset the gate (i.e., a node G) of the third transistor T3 and release the charge in the storage capacitor Cst.

In addition, in this phase, since a high level is inputted to the second signal input terminal Vgate and the enable signal terminal EM, thus, except the first transistor T1 and the third transistor T3, all of the other transistors are in a turned-off state.

In this phase, since the gate voltage VG of the third transistor T3 is reset (VG=Vint), thus a voltage signal for a previous frame remaining on the node G of the pixel circuit is released, which can prevent the residual voltage signal for the previous frame from having bad effect on a voltage signal for the next frame, and ensure stability of the potential at the node G.

Figure 5:
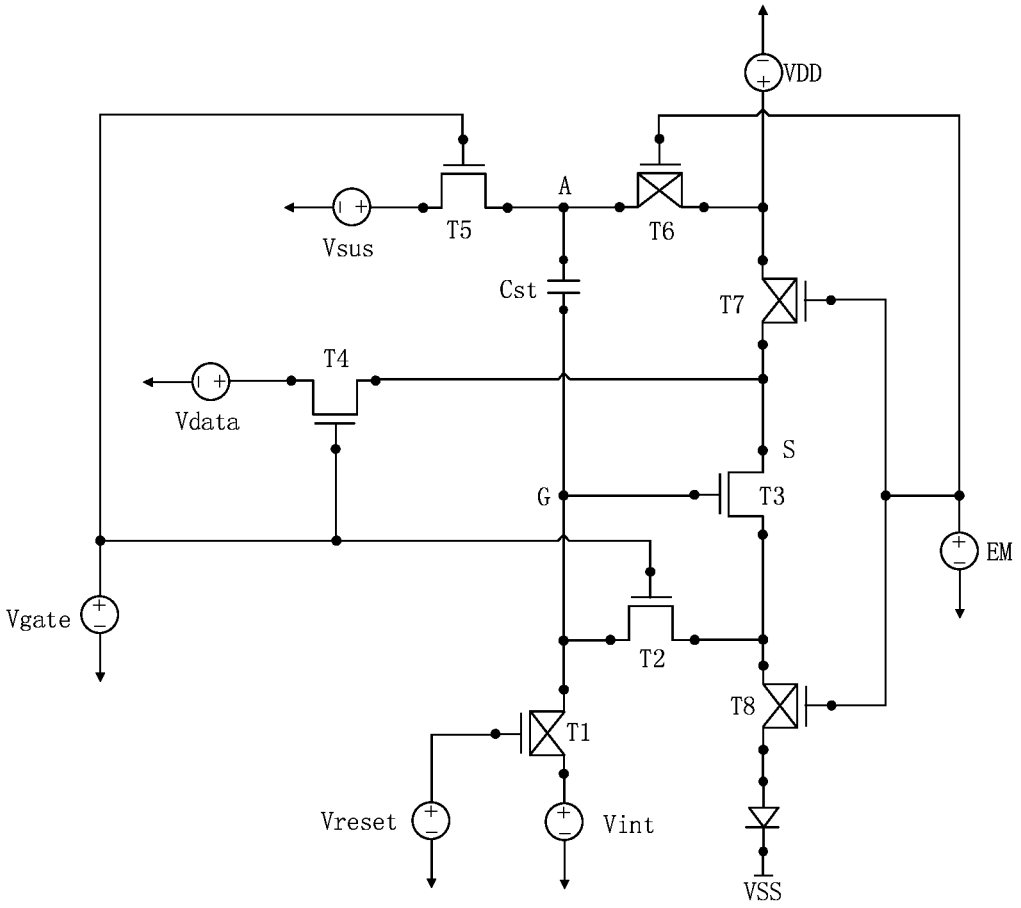
FIG. 5 is an equivalent circuit diagram of the pixel circuit of FIG. 2 in a phase P2 of FIG. 3*a;*

FIG. 5 is an equivalent circuit diagram of the pixel circuit of FIG. 2 in a phase P2 of FIG. 3*a*. As shown in FIG. 5, in the writing phase P2, a low level is inputted to the second signal input terminal Vgate, so that the second transistor T2, the fourth transistor T4, and the fifth transistor T5 can be turned on. In addition, since the node G remains at a low level, thus the third transistor T3 remains in the turned-on state. In this case, a high level is inputted from the second voltage terminal Vsus to charge the storage capacitor Cst, so that the voltage at the other terminal of the storage capacitor Cst, i.e., the voltage at a node A, is VA=Vsus. In addition, the high level inputted from the data voltage terminal Vdata may be written to the source of the third transistor T3, i.e., a node S, and after passing through the third transistor T3, a level which is less than a data voltage inputted from the data voltage terminal Vdata by a threshold voltage Vth of the third transistor T3 is inputted to the gate of the third transistor T3, so that the potential VG of the node G is VG=Vdata−(−|Vth|)=Vdata+|Vth|. Herein, the "(−|Vth|)" in this formula indicates that the threshold voltage of the third transistor T3 itself is a negative value, because in this embodiment, illustration is provided with each of the transistors being a P-type enhancement transistor as an example, and the threshold voltage of the P-type enhancement transistor is a negative value. At this time, the voltage between two terminals of the storage capacitor Cst is VG−VA=Vdata+|Vth|−Vsus.

In addition, in this phase, since a high level is inputted to the first signal input terminal Vreset, thus the first transistor T1 is in a turned-off state, and the enable signal terminal EM is also at a high level, thus the sixth transistor T6, the seventh transistor T7, and the eighth transistors T8 are in a turned-off state each.

Figure 6:
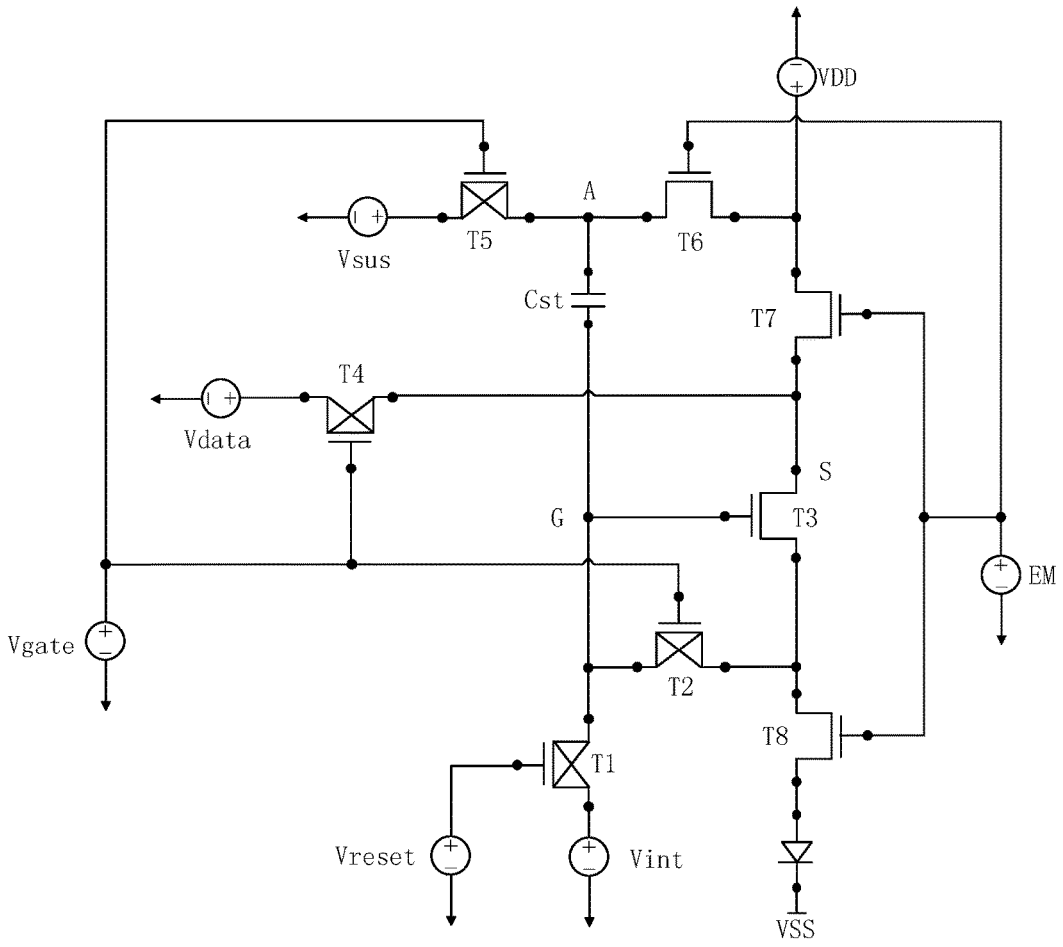
FIG. 6 is an equivalent circuit diagram of the pixel circuit of FIG. 2 in a phase P3 of FIG. 3*a;*

FIG. 6 is an equivalent circuit diagram of the pixel circuit of FIG. 2 in a phase P3 of FIG. 3*a*. As shown in FIG. 6, in the light emitting phase P3, a low level is inputted to the enable signal terminal EM, so that the sixth transistor T6, the seventh transistor T7, and the eighth transistor T8 are turned on. In addition, since the node G remains at a low level, thus the third transistor T3 remains in a turned-on state. In this case, the high level inputted from the third voltage terminal VDD is transferred to the other terminal of the storage capacitor, i.e., the node A, so that the potential at the node A becomes VDD. However, the voltage between two terminals of the storage capacitor Cst can be kept constant due to a bootstrap function of the storage capacitor Cst itself, and still is Vdata+|Vth|−Vsus of the writing phase P2, so that one voltage increment is generated at one terminal of the storage capacitor Cst, i.e., the node G, so that the voltage VG at the node G is VG=Vdata+|Vth|−Vsus+VDD.

Therefore, a gate-source voltage Vgs of the third transistor T3 (i.e., a voltage difference between the gate node G and the source node S) is:

$$Vgs(T3)=VG-VS=(Vdata+|Vth|-Vsus+VDD)-VDD=Vdata+|Vth|-Vsus.$$

In this case, a driving current I flowing through the third transistor T3 and the eighth transistor T8 is:

$$I=K/2(Vgs-|Vth|)^2=K/2(Vdata-Vsus)^2$$

where K is related to a width-length ratio (W/L) of a transistor channel.

Thus it can be seen that, on one hand, the driving current I flowing through the third transistor T3 is independent of the threshold voltage Vth of the third transistor T3. Accordingly, the pixel circuit described above can prevent the light emitting device L from being affected by the threshold voltage. In addition, although the driving current I also flows through the eighth transistor T8, since a size of the eighth transistor T8 serving as the switching transistor is smaller than a size of the third transistor T3 serving as the driving transistor, the influence caused by the threshold voltage of the eighth transistor T8 on the driving current I is negligible.

Figure 7:
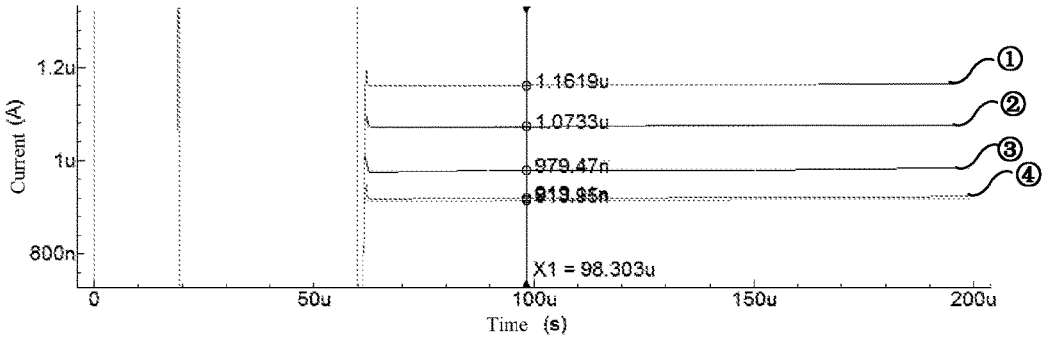
FIG. 7 is a diagram of compensation effect of that the pixel circuit in FIG. 2 compensates for the threshold voltage.

The compensation effect provided by the present disclosure for the threshold voltage Vth can be for example as shown in FIG. 7, the threshold voltage Vth of a different value corresponds to a different driving current I, as shown in Table 1:

TABLE 1

| Sampling curve | Vth | I |
|---|---|---|
| ① | −3 V | 1.1619 μA |
| ② | −2.5 V | 1.0733 μA |
| ③ | −2 V | 979.47 nA |
| ④ | −1.5 V | 919.95 nA |

Thus it can be derived that, when the threshold voltage Vth varies within a range of (−3V, −1.5V), a magnitude of change of the driving current I is in an order of nanoseconds (nA), thus change of the driving current I is very small. Accordingly, the effect caused by the threshold voltage Vth on the luminance of the light emitting device L is negligible.

On the other hand, when an OLED device emits light, driving currents of all the pixels are caused by that a power supply voltage is supplied by a scan driving unit 10 shown in FIG. 1 to respective pixel units 20 through a driving control line ELVDD, but the driving control line ELVDD has a certain resistance, thus, during the light emitting phase, a power supply voltage inputted to a pixel unit 20 located at a position closer to the scan driving unit 10 is higher than a power supply voltage inputted to a pixel unit (e.g., pixel units 20' in the last column) located at a position farther from the scan driving unit 10. This phenomenon is called resistance drop (IR Drop). Since the power supply voltage inputted by the scan driving unit 10 to the pixel unit 20 (or the pixel unit 20') is related to the current flowing through each pixel unit, the IR drop causes the current flowing through the pixel unit 20 at a different position to be different, which makes an AMOLED display have luminance difference at the time of displaying.

The driving current I described above is also independent of the power supply voltage inputted from the third voltage terminal VDD. Therefore, the affect caused on the current flowing through the light emitting device L by the ohmic voltage drop due to a different distance between the pixel unit and the third voltage terminal VDD can be avoided.

Figure 8:
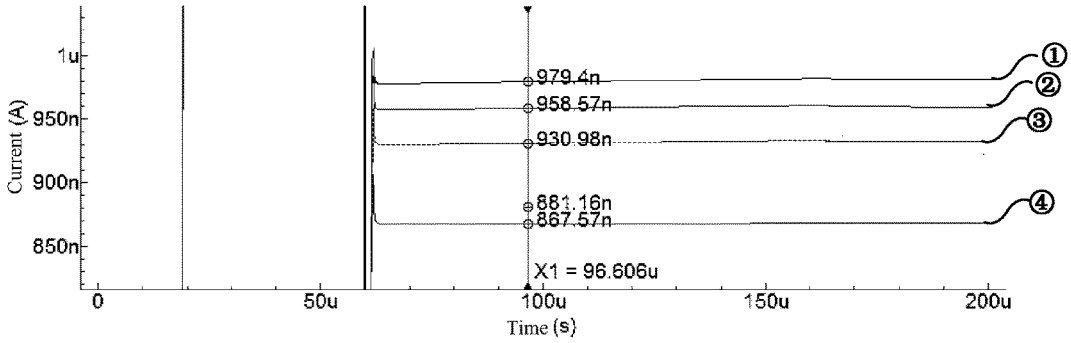
FIG. 8 is a diagram of compensation effect of that the pixel circuit in FIG. 2 compensates for a power supply voltage provided by the third voltage terminal.

For example, the compensation effect provided by the present disclosure for a third voltage VDD may be as shown in FIG. 8, the third voltage VDD of a different value corresponds to a different driving current I, as shown in Table 2:

TABLE 2

| Sampling curve | VDD | I |
|---|---|---|
| ① | 7 V | 979.4 nA |
| ② | 6.5 V | 958.57 nA |
| ③ | 5.5 V | 930.98 nA |
| ④ | 5 V | 867.57 nA |

Thus it can be derived that, when the voltage inputted from the third voltage terminal varies within a range of (7V, 5V), a magnitude of change of the driving current I is in an order of nanoseconds (nA), thus change of the driving current I is very small. Accordingly, the affect on the luminance of the light emitting device L due to the IR drop caused by the third voltage terminal VDD is negligible.

To sum up, uniformity of display luminance of the display device can be improved by adopting the pixel circuit provided by the embodiment of the present disclosure.

In addition, in this phase, signals inputted to the first signal input terminal Vreset and the second input terminal Vgate are at a high level, thus, the first transistor T1, the second transistor T2, the fourth transistor T4, and the fourth transistor T5 are all in a turned-off state.

Second Embodiment

In this embodiment, illustration is provided with each of the transistors being a P-type transistor as an example.

In this embodiment, illustration is provided with the first electrode of the first transistor T1 being connected to the second voltage terminal Vsus in the pixel circuit shown in FIG. 2 as an example, and the first electrode of the fifth transistor T5 is also connected to the second voltage terminal Vsus, thus the signal inputted to the first electrode of the first transistor T1 and the signal inputted to the first electrode of the fifth transistor T5 are the same. The control signal is as shown in FIG. 3*b*, from which it can be seen that, the second voltage terminal Vsus outputs a low level in the reset phase P1, and outputs a high level in the other phases. Since the second voltage terminal Vsus can output a low level in the reset phase P1, and output a high level in the writing phase P2 and the light emitting phase P3, thus the aim of resetting the gate voltage of the third transistor T3 in the reset phase P1 and releasing the voltage between two terminals of the storage capacitor Cst can also be achieved. And as stated above, the driving current I flowing through the third transistor T3 in the light emitting phase P3 also is:

$$I=K/2(Vgs-|Vth|)^2=K/2(Vdata-Vsus)^2.$$

Therefore, by adopting the solution in the second embodiment, it can also prevent the light emitting device L from being affected by the threshold voltage, and prevent the ohmic voltage drop caused by the third voltage terminal VDD from influencing the current flowing through the light emitting device L.

It should be noted that, in the first and second embodiments, in an ideal state, generally, Vdata−Vsus<0, so that $Vdata_{max}$≤Vsus. However, during manufacturing and using in practice, since the TFTs cannot be completely turned off due to being affected by a leakage current, so that the display screen is not in a complete black state after the display is turned off. Therefore, in order to ensure the black state of the display, optionally, the voltage inputted from the second voltage terminal Vsus may satisfy the following condition:

$$Vdata_{min} \le Vsus \le Vdata_{max}.$$

Third Embodiment

When the first electrode of the first transistor T1 in FIG. 2 is connected to the first voltage terminal Vint, each of the transistors in FIG. 2 may also be an N-type transistor.

In this case, it is also necessary to invert the signals inputted to the enable signal EM, the first signal input terminal Vreset, the first voltage terminal Vint, and the first signal input terminal Vgate in FIG. 3*a*.

In this way, in the reset phase P1, a high level inputted to the first signal input terminal Vreset turns on the first transistor T1, so that the high level inputted to the first voltage terminal Vint can reset the gate of the third transistor T3 (i.e., the node G), and the charge in the storage capacitor Cst can be released, and at this time, the gate voltage VG of the third transistor T3 is reset (VG=Vint).

In the writing phase P2, a high level is inputted to the second signal input terminal Vgate, the second transistor T2, the fourth transistor T4, and the fifth transistor T5 are turned on. Similar to those described in the first and second embodiments, it can be derived that, the voltage between two terminals of the storage capacitor Cst is VG−VA=Vdata+Vth−Vsus, wherein as for the N-type enhancement transistor, the threshold voltage is a positive value.

In the light emitting phase P3, a high level is inputted to the enable signal terminal EM, the sixth transistor T6, the seventh transistor T7, and the eighth transistor T8 are turned on. Similar to those described in the first and second embodiments, it can be derived that, the voltage VG at the node G is Vdata+Vth−Vsus+VDD.

Therefore, a gate-source voltage Vgs of the third transistor T3 (i.e., a voltage difference between the gate node G and the source node S') is:

$$Vgs(T3)=VG-VS'=(Vdata+Vth-Vsus+VDD)-VS'.$$

In this case, the driving current I flowing through the third transistor T3 and the eighth transistor T8 is:

$$I=K/2(Vgs-Vth)^2=K/2(Vdata-Vsus+VDD-VS')^2.$$

Thus it can be seen that, the driving current I flowing through the third transistor T3 is independent of the threshold voltage Vth of the third transistor T3, accordingly, the pixel circuit described above can prevent the light emitting device L from being affected by the threshold voltage.

To sum up, when all the transistors in the pixel circuit are P-type transistors, the pixel circuit provided by the embodiment of the present invention can avoid the influence caused by both the IR drop and the threshold voltage on the driving current concurrently. When all the transistors in the pixel circuit are N-type transistors, the pixel circuit provided by the embodiment of the present invention can avoid the influence caused by the threshold voltage on the driving current.

An embodiment of the present disclosure also provides a display device comprising any of the pixel circuit described above. The display device may comprise a plurality of arrays of pixel units, each pixel unit comprising any of the pixel circuit described above. The display device has the same advantageous effects as the pixel circuit provided in the foregoing embodiments of the present disclosure, since the pixel circuit has been described in detail in the foregoing embodiments, no details will be repeated herein.

For example, the display device provided by the embodiment of the present disclosure may be a display device with a current-driven light emitting element, including LED display or OLED display.

Figure 9:
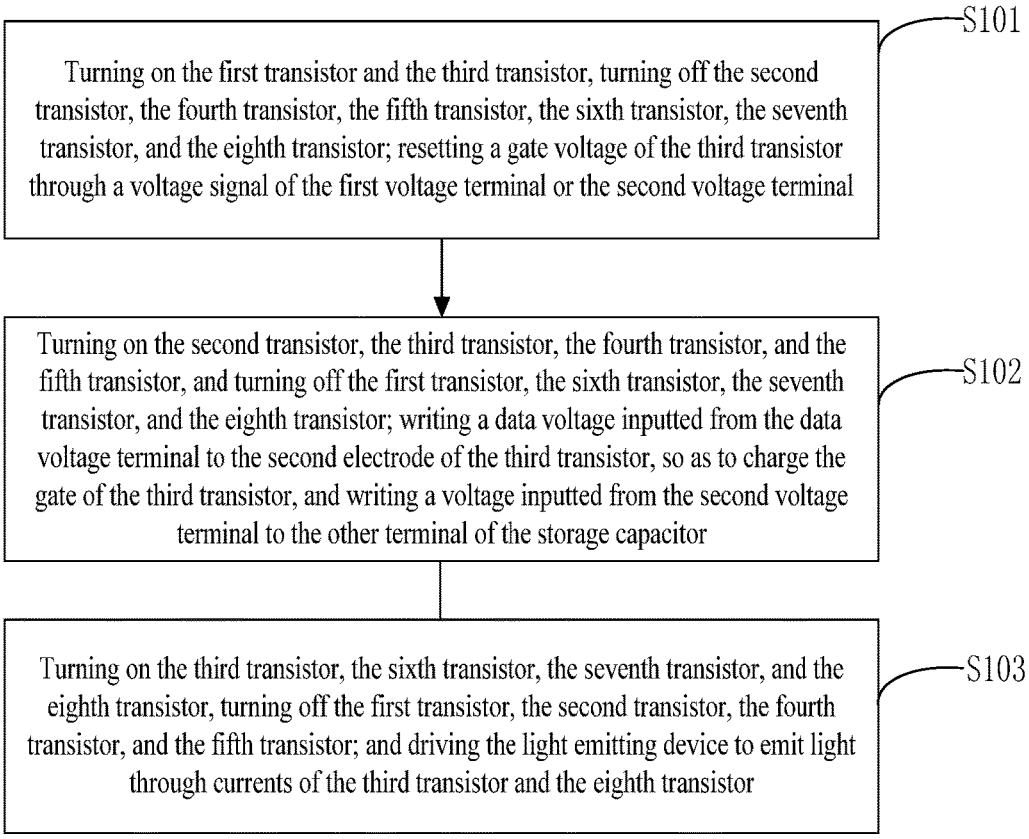
FIG. 9 is a flowchart of a driving method for a pixel circuit provided by an embodiment of the present disclosure.

An embodiment of the present disclosure also provides a driving method for driving any of the pixel circuit described above. As shown in FIG. 9, said method comprises the following steps.

S101: as shown in FIG. 4, turning on the first transistor T1 and the third transistor T3, turning off the second transistor T2, the fourth transistor T4, the fifth transistor T5, the sixth transistor T6, the seventh transistor T7, and the eighth transistor T8; resetting a gate voltage of the third transistor T3 through a voltage signal of the first voltage terminal Vint or the second voltage terminal Vsus.

For example, a low level inputted from the first voltage terminal Vint can reset the gate (i.e., the node G) of the third transistor T3 and release the charge in the storage capacitor Cst, thus a voltage signal for a previous frame remaining on the node G of the pixel circuit can be released, which can prevent the residual voltage signal for the previous frame from having bad effect on a voltage signal for the next frame, and ensure stability of the potential at the node G.

S102: as shown in FIG. 5, turning on the second transistor T2, the third transistor T3, the fourth transistor T4, and the fifth transistor T5, and turning off the first transistor T1, the sixth transistor T6, the seventh transistor T7, and the eighth transistor T8; writing a data voltage inputted from the data voltage terminal Vdata to the second electrode of the third transistor T3, so as to charge the gate of the third transistor T3, and writing a voltage inputted from the second voltage terminal Vsus to the other terminal of the storage capacitor Cst.

For example, a high level is inputted from the second voltage terminal Vsus to charge the storage capacitor Cst, so that the voltage at the other terminal of the storage capacitor Cst, i.e., the voltage at a node A, is VA=Vsus. In addition, the high level inputted from the data voltage terminal Vdata may be written to the source of the third transistor T3, i.e., a node S, and after passing through the third transistor T3, a level which is less than a data voltage inputted from the data voltage terminal Vdata by a threshold voltage Vth of the third transistor T3 is inputted to the gate of the third transistor T3, so that the potential VG of the node G is VG=Vdata−(−Vth)=Vdata+Vth.

S103: as shown in FIG. 6, turning on the third transistor T3, the sixth transistor T6, the seventh transistor T7, and the eighth transistor T8, turning off the first transistor T1, the second transistor T2, the fourth transistor T4, and the fifth transistor T5; and driving the light emitting device L to emit light through currents of the third transistor T3 and the eighth transistor.

The embodiment of the present disclosure provides a driving method for driving the pixel circuit described above, first, the first transistor and the third transistor are turned on, the second transistor, the fourth transistor, the fifth transistor, the sixth transistor, the seventh transistor, and the eighth transistor are turned off, a gate voltage of the third transistor is reset through a voltage signal of the first voltage terminal or the second voltage terminal; next, the second transistor, the third transistor, the fourth transistor, and the fifth transistor are turned on, the first transistor, the sixth transistor, the seventh transistor, and the eighth transistor are turned off, a data voltage inputted from the data voltage terminal is written to the second electrode of the third transistor, so as to charge the gate of the third transistor, and a voltage inputted from the second voltage terminal is written to the other terminal of the storage capacitor; and last, the third transistor, the sixth transistor, the seventh transistor, and the eighth transistor are turned on, the first transistor, the second transistor, the fourth transistor, and the fifth transistor are turned off; and the light emitting device is driven through currents of the third transistor and the eighth transistor to emit light.

In this way, the pixel circuit implements switching control and charging-discharging control over the circuit through a plurality of transistors and one storage capacitor, and keeps the voltage between two terminals of the storage capacitor constant due to a bootstrap function of the storage capacitor, so that the current flowing through the light emitting diode is independent of the threshold voltage of the TFTs, therefore, the problem of driving current instability and display luminance unevenness caused by drifting of the threshold voltage can be avoided.

Next, timing of the control signal in the driving method for the pixel circuit described above will be illustrated through exemplary embodiments, wherein, the pixel circuit in the embodiments provided below are described with each of the first transistor T1, the second transistor T2, the third transistor T3, the fourth transistor T4, the fifth transistor T5, the sixth transistor T6, the seventh transistor T7, and the eighth transistor T8 being a P-type enhancement transistor as an example.

Fourth Embodiment

In this embodiment, illustration is provided with each of the transistors in FIG. 2 being a P-type transistor as an example.

In this embodiment, illustration is provided with the first electrode of the first transistor T1 being connected to the first voltage terminal Vint in the pixel circuit shown in FIG. 2 as an example, and the control signal in the pixel circuit is shown in FIG. 3*a*.

In a case where the first electrode of the first transistor T1 is connected to the first voltage terminal Vint, when a low level is inputted from the first voltage terminal Vint and the fourth voltage terminal VSS and a high level is inputted from the second voltage terminal Vsus and the third voltage terminal VDD, timing of a control signal comprises the following.

In a reset phase P1, a high level is inputted to the enable signal terminal EM, a low level is inputted to the first signal input terminal Vreset, a high level is inputted to the second signal input terminal Vgate, and a low level is inputted to the data voltage terminal Vdata.

In this case, the first transistor T1 is turned on, so that the low level inputted from the first voltage terminal Vint can reset the gate (i.e., a node G) of the third transistor T3 and release the charge in the storage capacitor Cst.

In addition, in the reset phase P1, since a high level is inputted to the second signal input terminal Vgate and the enable signal terminal EM, thus, except the first transistor T1 and the third transistor T3, all of the other transistors are in a turned-off state.

In this phase, since the gate voltage VG of the third transistor T3 is reset (VG=Vint), thus a voltage signal for a previous frame remaining on the node G of the pixel circuit is released, which can prevent the residual voltage signal for the previous frame from having bad effect on a voltage signal for the next frame, and ensure stability of the potential at the node G.

In a writing phase P2, a high level is inputted to the enable signal terminal EM, a high level is inputted to the first signal input terminal Vreset, a low level is inputted to the second signal input terminal Vgate, and a high level is inputted to the data voltage terminal Vdata.

In this case, the second transistor T2, the fourth transistor T4, and the fifth transistor T5 are turned on. In addition, since the node G remains at a low level, thus the third transistor T3 remains in the turned-on state. In this case, a high level is inputted from the second voltage terminal Vsus to charge the storage capacitor Cst, so that the voltage at the other terminal of the storage capacitor Cst, i.e., the voltage at a node A, is VA=Vsus. In addition, the high level inputted from the data voltage terminal Vdata may be written to the source of the third transistor T3, i.e., a node S, and after passing through the third transistor T3, a level which is less than a data voltage inputted from the data voltage terminal Vdata by a threshold voltage Vth of the third transistor T3 is inputted to the gate of the third transistor T3, so that the potential VG of the node G is VG=Vdata−(−|Vth|)=Vdata+|Vth|. Herein, the "(−|Vth|)" in this formula indicates that the threshold voltage of the third transistor T3 itself is a negative value, because in this embodiment, illustration is provided with each of the transistors being a P-type enhancement transistor as an example, and the threshold voltage of the P-type enhancement transistor is a negative value. At this time, the voltage between the two terminals of the storage capacitor Cst is VG−VA=Vdata+|Vth|−Vsus.

In addition, in the writing phase P2, since a high level is inputted to the first signal input terminal Vreset, thus the first transistor T1 is in a turned-off state, and the enable signal terminal EM is also at a high level, so that the sixth transistor T6, the seventh transistor T7, and the eighth transistors T8 are in a turned-off state each.

In a light emitting phase P3, a low level is inputted to the enable signal terminal EM, a high level is inputted to the first signal input terminal Vreset, a high level is inputted to the second signal input terminal Vgate, and a low level is inputted to the data voltage terminal Vdata.

In this case, the sixth transistor T6, the seventh transistor T7, and the eighth transistor T8 are turned on. In addition, since the node G remains at a low level, thus the third transistor T3 remains in a turned-on state. In this case, the high level inputted from the third voltage terminal VDD is transferred to the other terminal of the storage capacitor, i.e., the node A, so that the potential at the node A becomes VDD. However, the voltage between two terminals of the storage capacitor Cst can be kept constant due to a bootstrap function of the storage capacitor Cst itself, and still is Vdata+|Vth|−Vsus of the writing phase P2, so that one voltage increment is generated at one terminal of the storage capacitor Cst, i.e., the node G, so that the voltage VG at the node G is VG=Vdata+|Vth|−Vsus+VDD.

Therefore, a gate-source voltage Vgs of the third transistor T3 (i.e., a voltage difference between the gate node G and the source node S) is:

$$Vgs(T3)=VG-VS=(Vdata+|Vth|-Vsus+VDD)-VDD=Vdata+|Vth|-Vsus.$$

In this case, a driving current I flowing through the third transistor T3 and the eighth transistor T8 is:

$$I=K/2(Vgs-|Vth|)^2=K/2(Vdata-Vsus)^2$$

where K is related to a width-length ratio (W/L) of a transistor channel.

Thus it can be seen that, on one hand, the driving current I flowing through the third transistor T3 is independent of the threshold voltage Vth of the third transistor T3. Accordingly, the pixel circuit described above can prevent the light emitting device L from being affected by the threshold voltage. In addition, although the driving current I also flows through the eighth transistor T8, since a size of the eighth transistor T8 serving as the switching transistor is smaller than a size of the third transistor T3 serving as the driving transistor, the influence caused by the threshold voltage of the eighth transistor T8 on the driving current I is negligible.

The compensation effect provided by the present disclosure for the threshold voltage Vth can be for example as shown in FIG. 7, the threshold voltage Vth of a different value corresponds to a different driving current I, as shown in Table 1:

TABLE 1

| Sampling curve | Vth | I |
|---|---|---|
| □ | −3 V | 1.1619 μA |
| □ | −2.5 V | 1.0733 μA |
| □ | −2 V | 979.47 nA |
| □ | −1.5 V | 919.95 nA |

Thus it can be derived that, when the threshold voltage Vth varies within a range of (−3V, −1.5V), a magnitude of change of the driving current I is in an order of nanoseconds (nA), thus change of the driving current I is very small. Accordingly, the effect caused by the threshold voltage Vth on the luminance of the light emitting device L is negligible.

On the other hand, the driving current I described above is also independent of the power supply voltage inputted from the third voltage terminal VDD. Therefore, the affect caused on the current flowing through the light emitting device L by the ohmic voltage drop due to a different distance between the pixel unit and the third voltage terminal VDD can be avoided.

For example, the compensation effect provided by the present disclosure for a third voltage VDD may be as shown in FIG. 8, the third voltage VDD of a different value corresponds to a different driving current I, as shown in Table 2:

TABLE 2

| Sampling curve | VDD | I |
|---|---|---|
| ① | 7 V | 979.4 nA |
| ② | 6.5 V | 958.57 nA |
| ③ | 5.5 V | 930.98 nA |
| ④ | 5 V | 867.57 nA |

Thus it can be derived that, when the voltage inputted from the third voltage terminal varies within a range of (7V, 5V), a magnitude of change of the driving current I is in an order of nanoseconds (nA), thus change of the driving current I is very small. Accordingly, the affect subjected to the IR drop caused by the third voltage terminal VDD on the luminance of the light emitting device L is negligible.

To sum up, uniformity of display luminance of the display device can be improved by adopting the pixel circuit provided by the embodiment of the present disclosure.

In addition, in the light emitting phase P3, signals inputted to the first signal input terminal Vreset and the second input terminal Vgate are at a high level, thus, the first transistor T1, the second transistor T2, the fourth transistor T4, and the fourth transistor T5 are all in a turned-off state.

Fifth Embodiment

In this embodiment, illustration is provided with each of the transistors in FIG. 2 being a P-type transistor as an example.

In this embodiment, illustration is provided with the first electrode of the first transistor T1 being connected to the second voltage terminal Vsus in the pixel circuit shown in FIG. 2 as an example, and the first electrode of the fifth transistor T5 is also connected to the second voltage terminal Vsus, thus the signal inputted to the first electrode of the first transistor T1 and the signal inputted to the first electrode of the fifth transistor T5 are the same. The control signal is as shown in FIG. 3*b*, from which it can be seen that, the second voltage terminal Vsus outputs a low level in the reset phase P1, and outputs a high level in the other phases.

In a case where the first electrode of the first transistor T1 is connected to the second signal input terminal Vgate, when a low level is inputted from the fourth voltage terminal VSS and a high level is inputted from the third voltage terminal VDD, timing of the control signal comprises the following.

In a reset phase P1, a high level is inputted to the enable signal terminal EM, a low level is inputted to the first signal input terminal Vreset, a low level is inputted to the second voltage terminal Vsus, a high level is inputted to the second signal input terminal Vgate, and a low level is inputted to the data voltage terminal Vdata.

In a writing phase P2, a high level is inputted to the enable signal terminal EM, a high level is inputted to the first signal input terminal Vreset, a high level is inputted to the second voltage terminal Vsus, a low level is inputted to the second signal input terminal Vgate, and a high level is inputted to the data voltage terminal Vdata.

In a light emitting phase P3, a low level is inputted to the enable signal terminal EM, a high level is inputted to the first signal input terminal Vreset, a high level is inputted to the second voltage terminal Vsus, a high level is inputted to the second signal input terminal Vgate, and a low level is inputted to the data voltage terminal Vdata.

To sum up, in the fifth embodiment, except that the signal inputted from the second voltage terminal Vsus changes, the signals at the other signal terminals are the same as those in the fourth embodiment. Since the second voltage terminal Vsus can output a low level in the reset phase P1, and output a high level in the writing phase P2 and the light emitting phase P3, thus the aim of resetting the gate voltage of the third transistor T3 in the reset phase P1 and releasing the voltage between two terminals of the storage capacitor Cst can also be achieved. And as stated above, the driving current I flowing through the third transistor T3 in the light emitting phase P3 also is:

$$I=K/2(V\text{gs}-|V\text{th}|)^2=K/2(V\text{data}-V\text{sus})^2.$$

Therefore, by adopting the solution in the fifth embodiment, it can also prevent the light emitting device L from being affected by the threshold voltage, and prevent the ohmic voltage drop caused by the third voltage terminal VDD from influencing the current flowing through the light emitting device L.

Sixth Embodiment

When the first electrode of the first transistor T1 in FIG. 2 is connected to the first voltage terminal Vint, each of the transistors in FIG. 2 may also be an N-type transistor.

In this case, it is also necessary to flip the signals inputted to the enable signal EM, the first signal input terminal Vreset, the first voltage terminal Vint, and the first signal input terminal Vgate in FIG. 3*a*.

In this way, in the reset phase P1, a high level inputted to the first signal input terminal Vreset to turn on the first transistor T1, so that the high level inputted from the first voltage terminal Vint can reset the gate of the third transistor T3 (i.e., the node G), and the charge in the storage capacitor Cst can be released, and at this time, the gate voltage VG of the third transistor T3 is reset (VG=Vint).

In the writing phase P2, a high level is inputted to the second signal input terminal Vgate, the second transistor T2, the fourth transistor T4, and the fifth transistor T5 are turned on. Similar to those described in the first and second embodiments, it can be derived that, the voltage between two terminals of the storage capacitor Cst is VG−VA=Vdata+Vth−Vsus, wherein as for the N-type enhancement transistor, the threshold voltage is a positive value.

In the light emitting phase P3, a high level is inputted to the enable signal terminal EM, the sixth transistor T6, the seventh transistor T7, and the eighth transistor T8 are turned on. Similar to those described in the first and second embodiments, it can be derived that, the voltage VG at the node G is Vdata+Vth−Vsus+VDD.

Therefore, a gate-source voltage Vgs of the third transistor T3 (i.e., a voltage difference between the gate node G and the source node S') is:

$$V\text{gs}(T3)=VG-VS'=(V\text{data}+V\text{th}-V\text{sus}+VDD)-VS'.$$

In this case, the driving current I flowing through the third transistor T3 and the eighth transistor T8 is:

$$I=K/2(V\text{gs}-V\text{th})^2=K/2(V\text{data}-V\text{sus}+VDD-VS')^2.$$

Thus it can be seen that, the driving current I flowing through the third transistor T3 is independent of the threshold voltage Vth of the third transistor T3, accordingly, the pixel circuit described above can prevent the light emitting device L from being affected by the threshold voltage.

To sum up, when all the transistors in the pixel circuit are P-type transistors, the pixel circuit provided by the embodiment of the present invention can avoid the influence caused by both the IR drop and the threshold voltage on the driving current concurrently. When all the transistors in the pixel circuit are N-type transistors, the pixel circuit provided by the embodiment of the present invention can avoid the influence caused by the threshold voltage on the driving current.

The above described merely are specific implementations of the present disclosure, but the protection scope of the present disclosure is not limited thereto, modification and replacements easily conceivable for those skilled in the art within the technical range revealed by the present disclosure all fall into the protection scope of the present disclosure. Therefore, the protection scope of the present disclosure is based on the protection scope of the claims.

The present application claims priority of the Chinese Patent Application No. 201510148701.4 filed on Mar. 31, 2015, the entire disclosure of which is hereby incorporated in full text by reference as part of the present application.

What is claimed is:

1. A pixel circuit, comprising: a first transistor, a second transistor, a third transistor, a fourth transistor, a fifth transistor, a sixth transistor, a seventh transistor, an eighth transistor, a storage capacitor, and a light emitting device;

a gate of the first transistor is connected to a first signal input terminal, a first electrode of the first transistor is connected to a first voltage terminal or a second voltage terminal, and a second electrode of the first transistor is connected to a first electrode of the second transistor;

a gate of the second transistor is directly connected to a second signal input terminal and directly receive a second signal, and a second electrode of the second transistor is connected to a first electrode of the eighth transistor;

a gate of the third transistor is connected to one terminal of the storage capacitor, a first electrode of the third transistor is connected to the first electrode of the eighth transistor, and a second electrode of the third transistor is connected to a first electrode of the fourth transistor;

a gate of the fourth transistor is directly connected to the second signal input terminal and directly receive the second signal, and a second electrode of the fourth transistor is connected to a data voltage terminal;

a gate of the fifth transistor is directly connected to the second signal input terminal and directly receive the second signal, a first electrode of the fifth transistor is connected to the second voltage terminal, and a second electrode of the fifth transistor is connected to the other terminal of the storage capacitor;

a gate of the sixth transistor is connected to an enable signal terminal, a first electrode of the sixth transistor is connected to the other terminal of the storage capacitor, and a second electrode of the sixth transistor is connected to a first electrode of the seventh transistor, a gate of the seventh transistor is connected to the enable signal terminal, the first electrode of the seventh transistor is connected to a third voltage terminal, and a second electrode of the seventh transistor is connected to the second electrode of the third transistor;

a gate of the eighth transistor is connected to the enable signal terminal, and a second electrode of the eighth transistor is connected to an anode of the light emitting device; and a cathode of the light emitting device is connected to a fourth voltage terminal.

2. The pixel circuit according to claim 1, wherein each of the first transistor, the second transistor, the third transistor, the fourth transistor, the fifth transistor, the sixth transistor, the seventh transistor, and the eighth transistor is a P-type transistor;

the first electrode of each of said transistors is a drain, and the second electrode of each of said transistors is a source.

3. The pixel circuit according to claim 1, wherein said transistors include transistors of depletion type or transistors of enhancement type.

4. The pixel circuit according to claim 1, wherein the light emitting device is an organic light emitting diode.

5. A display device, comprising the pixel circuit according to claim 1.

6. A driving method for driving the pixel circuit according to claim 1, comprising:

turning on the first transistor and the third transistor, turning off the second transistor, the fourth transistor, the fifth transistor, the sixth transistor, the seventh transistor, and the eighth transistor; resetting a gate voltage of the third transistor through a voltage signal of the first voltage terminal or the second voltage terminal;

turning on the second transistor, the third transistor, the fourth transistor, and the fifth transistor, and turning off the first transistor, the sixth transistor, the seventh transistor, and the eighth transistor; writing a data voltage inputted from the data voltage terminal to the second electrode of the third transistor, so as to charge the gate of the third transistor, and writing a voltage inputted from the second voltage terminal to the other terminal of the storage capacitor; and turning on the third transistor, the sixth transistor, the seventh transistor, and the eighth transistor, turning off the first transistor, the second transistor, the fourth transistor, and the fifth transistor; and driving the light emitting device to emit light through currents of the third transistor and the eighth transistor.

7. The driving method according to claim 6, wherein each of the first transistor, the second transistor, the third transistor, the fourth transistor, the fifth transistor, the sixth transistor, the seventh transistor, and the eighth transistor is a P-type transistor;

the first electrode of each of said transistors is a drain, and the second electrode of each of said transistors is a source.

8. The driving method according to claim 7, wherein in a case where the first electrode of the first transistor is connected to the first voltage terminal, when a low level is inputted from the first voltage terminal and the fourth voltage terminal and a high level is inputted from the second voltage terminal and the third voltage terminal, timing of a control signal comprises:

in a reset phase, a high level is inputted to the enable signal terminal, a low level is inputted to the first signal input terminal, a high level is inputted to the second signal input terminal, and a low level is inputted to the data voltage terminal;

in a writing phase, a high level is inputted to the enable signal terminal, a high level is inputted to the first signal input terminal, a low level is inputted to the second signal input terminal, and a high level is inputted to the data voltage terminal; and in a light emitting phase, a low level is inputted to the enable signal terminal, a high level is inputted to the first signal input terminal, a high level is inputted to the second signal input terminal, and a low level is inputted to the data voltage terminal; and wherein in a case where the first electrode of the first transistor is connected to the second voltage terminal, when a low level is inputted from the fourth voltage terminal and a high level is inputted from the third voltage terminal, timing of the control signal comprises:

in a reset phase, a high level is inputted to the enable signal terminal, a low level is inputted to the first signal input terminal, a low level is inputted to the second voltage terminal, a high level is inputted to the second signal input terminal, and a low level is inputted to the data voltage terminal;

in a writing phase, a high level is inputted to the enable signal terminal, a high level is inputted to the first signal input terminal, a high level is inputted to the second voltage terminal, a low level is inputted to the second signal input terminal, and a high level is inputted to the data voltage terminal; and in a light emitting phase, a low level is inputted to the enable signal terminal, a high level is inputted to the first signal input terminal, a high level is inputted to the second voltage terminal, a high level is inputted to the second signal input terminal, and a low level is inputted to the data voltage terminal.

9. A display device, comprising the pixel circuit according to claim 2.

10. A display device, comprising the pixel circuit according to claim 3.

11. A display device, comprising the pixel circuit according to claim 4.

12. A driving method for driving the pixel circuit according to claim 2, comprising:

turning on the first transistor and the third transistor, turning off the second transistor, the fourth transistor, the fifth transistor, the sixth transistor, the seventh transistor, and the eighth transistor; resetting a gate voltage of the third transistor through a voltage signal of the first voltage terminal or the second voltage terminal;

turning on the second transistor, the third transistor, the fourth transistor, and the fifth transistor, and turning off the first transistor, the sixth transistor, the seventh transistor, and the eighth transistor; writing a data voltage inputted from the data voltage terminal to the second electrode of the third transistor, so as to charge the gate of the third transistor, and writing a voltage inputted from the second voltage terminal to the other terminal of the storage capacitor; and turning on the third transistor, the sixth transistor, the seventh transistor, and the eighth transistor, turning off the first transistor, the second transistor, the fourth transistor, and the fifth transistor; and driving the light emitting device to emit light through currents of the third transistor and the eighth transistor.

13. The driving method according to claim 12, wherein each of the first transistor, the second transistor, the third transistor, the fourth transistor, the fifth transistor, the sixth transistor, the seventh transistor, and the eighth transistor is a P-type transistor;

the first electrode of each of said transistors is a drain, and the second electrode of each of said transistors is a source.

14. The driving method according to claim 13, wherein in a case where the first electrode of the first transistor is connected to the first voltage terminal, when a low level is inputted from the first voltage terminal and the fourth voltage terminal and a high level is inputted from the second voltage terminal and the third voltage terminal, timing of a control signal comprises:

in a reset phase, a high level is inputted to the enable signal terminal, a low level is inputted to the first signal input terminal, a high level is inputted to the second signal input terminal, and a low level is inputted to the data voltage terminal;

in a writing phase, a high level is inputted to the enable signal terminal, a high level is inputted to the first signal input terminal, a low level is inputted to the second signal input terminal, and a high level is inputted to the data voltage terminal; and in a light emitting phase, a low level is inputted to the enable signal terminal, a high level is inputted to the first signal input terminal, a high level is inputted to the second signal input terminal, and a low level is inputted to the data voltage terminal, and wherein in a case where the first electrode of the first transistor is connected to the second signal input terminal, when a low level is inputted from the fourth voltage terminal and a high level is inputted from the third voltage terminal, timing of the control signal comprises:

in a reset phase, a high level is inputted to the enable signal terminal, a low level is inputted to the first signal input terminal, a low level is inputted to the second voltage terminal, a high level is inputted to the second signal input terminal, and a low level is inputted to the data voltage terminal;

in a writing phase, a high level is inputted to the enable signal terminal, a high level is inputted to the first signal input terminal, a high level is inputted to the second voltage terminal, a low level is inputted to the second signal input terminal, and a high level is inputted to the data voltage terminal; and in a light emitting phase, a low level is inputted to the enable signal terminal, a high level is inputted to the first signal input terminal, a high level is inputted to the second voltage terminal, a high level is inputted to the second signal input terminal, and a low level is inputted to the data voltage terminal.

15. A driving method for driving the pixel circuit according to claim 3, comprising:

turning on the first transistor and the third transistor, turning off the second transistor, the fourth transistor, the fifth transistor, the sixth transistor, the seventh transistor, and the eighth transistor; resetting a gate voltage of the third transistor through a voltage signal of the first voltage terminal or the second voltage terminal;

turning on the second transistor, the third transistor, the fourth transistor, and the fifth transistor, and turning off the first transistor, the sixth transistor, the seventh transistor, and the eighth transistor; writing a data voltage inputted from the data voltage terminal to the second electrode of the third transistor, so as to charge the gate of the third transistor, and writing a voltage inputted from the second voltage terminal to the other terminal of the storage capacitor; and turning on the third transistor, the sixth transistor, the seventh transistor, and the eighth transistor, turning off the first transistor, the second transistor, the fourth transistor, and the fifth transistor; and driving the light emitting device to emit light through currents of the third transistor and the eighth transistor.

16. The driving method according to claim 15, wherein each of the first transistor, the second transistor, the third transistor, the fourth transistor, the fifth transistor, the sixth transistor, the seventh transistor, and the eighth transistor is a P-type transistor;

the first electrode of each of said transistors is a drain, and the second electrode of each of said transistors is a source.

17. The driving method according to claim 16, wherein in a case where the first electrode of the first transistor is connected to the first voltage terminal, when a low level is inputted from the first voltage terminal and the fourth voltage terminal and a high level is inputted from the second voltage terminal and the third voltage terminal, timing of a control signal comprises:

in a reset phase, a high level is inputted to the enable signal terminal, a low level is inputted to the first signal input terminal, a high level is inputted to the second signal input terminal, and a low level is inputted to the data voltage terminal;

in a writing phase, a high level is inputted to the enable signal terminal, a high level is inputted to the first signal input terminal, a low level is inputted to the second signal input terminal, and a high level is inputted to the data voltage terminal; and in a light emitting phase, a low level is inputted to the enable signal terminal, a high level is inputted to the first signal input terminal, a high level is inputted to the second signal input terminal, and a low level is inputted to the data voltage terminal, wherein in a case where the first electrode of the first transistor is connected to the second signal input terminal, when a low level is inputted from the fourth voltage terminal and a high level is inputted from the third voltage terminal, timing of the control signal comprises:

in a reset phase, a high level is inputted to the enable signal terminal, a low level is inputted to the first signal input terminal, a low level is inputted to the second voltage terminal, a high level is inputted to the second signal input terminal, and a low level is inputted to the data voltage terminal;

in a writing phase, a high level is inputted to the enable signal terminal, a high level is inputted to the first signal input terminal, a high level is inputted to the second voltage terminal, a low level is inputted to the second signal input terminal, and a high level is inputted to the data voltage terminal; and in a light emitting phase, a low level is inputted to the enable signal terminal, a high level is inputted to the first signal input terminal, a high level is inputted to the second voltage terminal, a high level is inputted to the second signal input terminal, and a low level is inputted to the data voltage terminal.

* * * * *